US005718999A

United States Patent [19]

Suzuki et al.

[11] Patent Number: 5,718,999

[45] Date of Patent: Feb. 17, 1998

[54] TONER COPOLYMER BINDER

[75] Inventors: Tatsuo Suzuki; Takashi Ueyama, both of Shiga-Ken, Japan

[73] Assignee: Sekisui Chemical Co., Ltd., Osaka, Japan

[21] Appl. No.: 723,754

[22] Filed: Sep. 30, 1996

[30] Foreign Application Priority Data

Nov. 24, 1995 [JP] Japan ..... 7-305610

[51] Int. Cl.[6] ..... G03G 9/087

[52] U.S. Cl. ..... 430/107; 730/109

[58] Field of Search ..... 430/106, 107, 430/137, 109

[56] References Cited

U.S. PATENT DOCUMENTS 4,543,312 9/1985 Morakawa et al. ..... 430/107

5,321,091 6/1994 Hiyousa et al. ..... 430/107

5,585,215 12/1996 Ong et al. ..... 430/107

FOREIGN PATENT DOCUMENTS 56-16144 2/1981 Japan .

56-158340 12/1981 Japan .

58-202455 11/1983 Japan .

*Primary Examiner*—John Goodrow

*Attorney, Agent, or Firm*—Townsend&Banta

[57] ABSTRACT

A toner whose main binder is a vinyl-type copolymer which has a styrene-type monomer and/or a (meth)acrylic ester monomer as constituent units wherein the vinyl-type copolymer has peaks of the molecular weight distribution at least in the range from $3\times10^3$ to $4\times10^4$ and in the range from $3\times10^5$ to $8\times10^6$, and the BET specific surface area of the main binder is 0.02–0.2 $m^2/g$.

11 Claims, No Drawings

TONER COPOLYMER BINDER

RELATED APPLICATIONS

This application claims the priority of Japanese Patent application No.7-305610 filed on Nov. 24, 1995, which is incorporeted herein by reference.

BACKGROUND OF THE INVENTION

1. Field of the Invention

This invention relates in general to a toner used in electrophotography and such, and more particularly to a toner used in a so-called dry development method which is one of the methods to develop electrostatic charge images.

2. The Prior Art

Carbon black, as a coloring agent, and electrification control substances such as dyes and pigments to control frictional electrification are added to a toner for developing agents. These electrification control substances give positive charge or negative charge to the toner and they are disclosed in Japanese examined patent publications Tokko Sho 41-20153 and Tokko Sho 44-6397, as well as in Japanese unexamined patent publications Tokkai Sho 53-127726 and Tokkai Sho 57-141452.

The performance of these compounds as electrification control substances was sufficient. However, they were hard to disperse in the resin and they did not necessarily disperse uniformly in the toner. Because of this, part of the toner was charged reversely, causing image fogging.

Also, aggregations of carbon black were formed due to insufficient dispersion of carbon black, causing defective fixation and image fogging.

Furthermore, along with copiers' progress toward higher resolution in recent years, demand for fine particle toners has increased and it has become necessary to disperse coloring agents and electrification control substances more uniformly.

Introduction of a compatibilizer and such was proposed to disperse the coloring agents and the electrification control substances more uniformly. However, they had shortcomings in that they bled to the toner surface causing image fogging and that they volatilize and attach themselves to the peeling pick of the fixation roll during prolonged running, resulting in paper jamming.

BRIEF SUMMARY OF THE INVENTION

The present invention intends to improve the aforementioned shortcomings and its object is to provide a fine-particle toner which gives high resolution images without image fogging or defective fixation and does not cause paper jamming even when the copier is used for a long duration of time.

The present invention provides a toner whose main binder is a vinyl-type copolymer which has a styrone-type monomer and/or a (moth)acrylic ester monomer as constituent units wherein the vinyl-type copolymer has peaks of the molecular weight distribution at least in the range from $3\times10^3$ to $4\times10^4$ and in the range from $3\times10^5$ to $8\times10^6$, and the BET specific surface area of the main binder is 0.02–0.2 $m^2/g$.

Also, the present invention provides the aforementioned toner wherein the particle size of said toner is 10 μm or less.

Also, the present invention provides the aforementioned toner wherein the peak height ratio between the peak in the range from $3\times10^3$ to $4\times10^4$ and the peak in the range from $3\times10^5$ to $8\times10^6$ in the molecular weight distribution is 0.15–1.0.

Also, the present invention provides the aforementioned toner wherein the packed bulk density of said main binder is less than 0.68 g/cc.

Also, the present invention provides the aforementioned toner wherein the angle of fall of said main binder is less than 27 degrees.

Also, the present invention provides the aforementioned toner wherein the electrostatic charge of said main binder is less than 3 μC/g.

Also, the present invention provides the aforementioned toner whose main binder is a vinyl-type copolymer which has a styrene-type monomer and/or a (meth)acrylic ester monomer as constituent units wherein the vinyl -type copolymer has peaks of the molecular weight distribution at least in the range from $3\times10^3$ to $4\times10^4$ and in the range from $3\times10^5$ to $8\times10^6$, the BET specific surface area of the main binder is 0.01–1 $m^2/g$, the average particle size of the toner is 10 μm or less, the peak height ratio between the peak in the range from $3\times10^3$ to $4\times10^4$ and the peak in the range from $3\times10^5$ to $8\times10^6$ in the molecular weight distribution is 0.15–1.0, the packed bulk density of said main binder is less than 0.68 g/cc, the angle of fall of said main binder is less than 27 degrees, and the electrostatic charge of said main binder is less than 3 μC/g.

DETAILED DESCRIPTION

The inventors conducted various investigations to solve the aforementioned problems and discovered that the BET specific surface area of the binder had an influence on the dispersion of coloring agents and electrification control substances into the binder. This is because a reduced specific surface area of the binder reduces the contact area between the binder and coloring agents and/or electrification control substances, resulting in not enough coloring agents and/or electrification control substances taken into the binder during kneading.

On the other hand, if the BET specific surface area is too large, then, because vinyl-type copolymers have a strong floodability, bridging tends to occur and the binder agglomerates, making it harder for the binder to contact the surface of coloring agents and/or electrification control substances and take them in.

Specifically, the BET specific surface area in the present invention has to be in the range of 0.01–1 $m^2/g$, preferably 0.02–0.2 $m^2/g$.

The vinyl-type copolymer, the main binder in the present invention, is a copolymer of vinyl monomers. It is a copolymer which has at least a styrene-type monomer and/or a (meth)acrylic ester monomer as constituent units, and the most preferable is a copolymer between a styrene-type monomer and a (meth)acrylic ester monomer.

Specific examples of the styrene-type monomer in the present invention include styrene, o-methyl styrene, p-methyl styrene, α-methyl styrene, p-ethyl styrene, 2,4-dimethyl styrene, p-n-butyl styrene, p-ter-butyl styrene, p-n-hexyl styrene, p-n-octyl styrene, p-n-dodecyl styrene, p-methoxy styrene, p-phenyl styrene, p-chloro styrene and 3,4-dichlogo styrene.

Specific examples of the (meth)acrylic ester monomer of the present invention are alkyl esters of acrylic acid or methacrylic acid including methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate and stearyl methacrylate, as well as 2-chloroethyl acrylate, phenyl acrylate, methyl α-chloro acrylate, phenyl methacrylate, dimethylaminoethyl methacrylate, diethylaminoethyl metacrylate, 2-hydroxyethyl methacrylate, glycidyl methacrylate, bisglycidyl methacrylate, polyethylene glycol dimethacrylate, methacryloxyethyl phosphate, etc. Of these, ethyl acrylate, propyl acrylate, butyl acrylate, methyl methacrylate, ethyl methacrylate, propyl methacrylate, butyl methacrylate, etc. are more preferably used.

In the present invention, other vinyl-type monomers can be used in addition to the aforementioned styrene-type monomers and/or the (meth)acrylic ester monomers. Examples of these other vinyl-type monomers are acrylic acid and/or its α- or β-alkyl derivatives including acrylic acid, methacrylic acid, α-ethyl acrylic acid and crotonic acid, unsaturated dicarboxylic acid including fumaric acid, maleic acid, citraconic acid and itaconic acid, monoacryloyloxyethyl ester succinate, monomethacryloyloxyethyl ester succinate, acrylonitrile, methacrylonitrile, acryl amide, etc.

Selection of the vinyl-type copolymer of the present invention is not limited in particular as long as it is normally used as a toner resin. However, it has to have peaks of the molecular weight distribution in the range from $3\times10^3$ to $4\times10^4$ and also in the range from $3\times10^5$ to $8\times10^6$.

The reasons for this requirement follow: the low molecular weight vinyl-type copolymer gives sufficient fixation, the high molecular weight vinyl -type copolymer improves the anti-offset properties, and the addition of the high molecular weight component, which has a smaller reduction of viscosity at high temperatures, produces a higher shearing stress during toner kneading, resulting in better dispersion of the coloring agents and/or the electrification control substances.

The peak height ratio between the peak in the range from $3\times10^3$ to $4\times10^4$ and the peak in the range from $3\times10^5$ to $8\times10^6$ in the molecular weight distribution is preferably 0.15–1.0. If it is above this range, then the anti-offset properties decrease. If it is below this range, then fixability may be reduced.

Also, in the present invention, it is desirable in terms of aggregation properties that the glass transition temperature of the vinyl-type copolymer for the main binder be 50° C. or higher.

The vinyl-type copolymer of the present invention can be synthesized by means of suspension polymerization, emulsion polymerization, solution polymerization, bulk polymerization, etc.

For the toner of the present invention, vinyl acetate, vinyl chloride, ethylene, etc. can be copolymerized in said vinyl-type copolymer and polymers of these monomers can be blended in said vinyl-type copolymer if they are used within a range in which the object of the present invention can be achieved. It is also possible to mix in polyester resins and/or epoxy resins, as well as aliphatic amide, metal soap, paraffin, etc.

For the electrification control substances added to the toner of the present invention, dyes such as Nigrosine and Spiron Black (from Hodogaya Kagaku) and/or phthalocyanine-type pigments can be used.

For the coloring agent added to the toner of the present invention, carbon black, chrome yellow, aniline blue, etc. can be used.

For the separability agent added to the toner of the present invention, low molecular weight polyethylene, polypropylene wax, etc. can be used. Hydrophobic silica can be used to increase flowability.

Furthermore, 10–80 wt % of magnetic fine particles can be added to the toner of the present invention to make it a magnetic toner.

The packed bulk density of the main binder is preferably less than 0.68 g/cc. If it is more than this, the apparent surface area of the main binder decreases and the contact area with the coloring agent and/or the electrification control substance also decreases, resulting in poor dispersion.

The angle of fall of the main binder is preferably less than 27 degrees. If it is more than this, then floodability becomes higher and bridging may occur.

The electrostatic charge of the main binder is preferably less than 3 μC. If it is more than this, the apparent surface area of the main binder decreases due to aggregation of the binder from static electricity and the contact area with the coloring agents and/or the electrification control substances also decreases, resulting in poor dispersion.

The toner of the present invention has a higher ability to disperse the coloring agents and/or the electrification control substances, and it is particularly suitable for a toner with an average particle size of 10 μm or less.

Use of a vinyl-type copolymer with a specific BET specific surface area for the main binder increases the contact area with the coloring agents and/or the electrification control substances and therefore a sufficient amount of the coloring agents and/or the electrification control substances are taken into the main binder. Furthermore, the high molecular weight vinyl-type copolymer produces a high shearing stress during kneading, resulting in better dispersion of the coloring agents and/or the electrification control substances. This makes it possible to provide a toner which gives high resolution images without image fogging or defective fixation and does not cause paper jamming even when the copier is used for a long duration of time.

The present invention, by means of using a vinyl-type copolymer with a specific BET specific surface area for the main binder, has made it possible to provide a small particle size toner which gives high resolution images without image fogging or defective fixation and does not cause paper jamming even when the copier is used for a long duration of time.

EXAMPLES

The present invention is described in detail below by referring to examples. The present invention is not limited to these examples.

Example 1

1 liter of toluene was put into a 5-liter separatable flask. After the gas phase was replaced by nitrogen gas, the system was heated to the boiling point of toluene. After the refluxing of toluene had begun, a dissolved mixture of 850 g of styrene, 150 g of n-butyl acrylate and 30 g of azobisisobutyronitrile, as a polymerization starter, was dripped into the system for 3 hours with stirring, during which time the solution polymerization took place. After the completion of dripping, the system was aged for 6 hours with stirring at the boiling temperature of toluene. 1 liter of toluene and 550 g of a resin with a peak molecular weight of 400,000, obtained by polymerizing 70 parts of styrene and 30 parts of n-butyl methacrylate, were put into this separatable flask. After the refluxing of toluene had begun, mixing was conducted with stirring for 5 hours. The system temperature was then gradually raised to 180° C., while toluene was removed under reduced pressure to obtain resin A which has a glass transition temperature of 63° C., a lower molecular weight peak at 15,000, a higher molecular weight peak at 400,000 and a peak height ratio between the higher molecular weight peak and the lower molecular weight peak of 0.6. Resin A, crushed with a 3-mm round-type screen of Fitz-mill DKA-6 (from Hosokawa Micron, Ltd.), had a BET specific surface area of 0.08 $m^2/g$, a packed bulk density of 0.64 g/cc, an angle of fall of 21 degrees and electrostatic charge of 0.7 μC. The BET specific surface area was measured with a conventional method using krypton gas. The packed bulk density and the angle of fall were measured using a powder tester (from Hosokawa Micron, Ltd.), which seemed to be the most common method. The electrostatic charge was measured with a blow-off powder electrostatic charge measurement instrument (from Toshiba Chemical, Ltd.) using powder with a particle size of 30 micrometers or less. 100 weight parts of this resin powder, 9 weight parts of carbon black (from Mitsubishi Chemical Industries, Ltd., product name: MA-100), 1 weight part of Spiron Black TRH (from Hodogaya Kagaku Co., Ltd.) and 3 weight parts of PP wax (from Sanyo Chemical Industries, Ltd., product name: Viscol 550P) were mixed and melt-kneaded using a continuous kneader (from Kurimoto Ltd.). After cooling, the mixture was coarsely crushed and then finely crushed with a jet-mill to obtain toner powder with an average particle size of approximately 8 μm. A toner was prepared by adding 0.3 weight parts of hydrophobic silica powder (from Aerosil Japan, product name: R-972) to this toner powder. 10 g of this toner was put into a 100 ml sample bottle, and let stand for 8 hours in a 50° C. thermostatic bath, followed by measurement of the degree of aggregation using a powder tester (from Hosokawa Micron, Ltd.). No aggregation was observed. This toner was used to make copies. The electronic copier used was Toshiba Leo dry 5540 with some modifications. No offset was observed on copied images even with a fixation roller temperature of 200° C. Images fixed with a fixation roller temperature of 170° C. were sufficiently fixed even after being rubbed with a finger. A running test of 10,000 copies was conducted and high quality images with no image fogging or defective fixation were obtained. Also, no jamming onto the fixation roller was observed.

Example 2

1 liter of toluene was put into a 5-liter separatable flask. After the gas phase was replaced by nitrogen gas, the system was heated to the boiling point of toluene. After the refluxing of toluene had begun, a dissolved mixture of 850 g of styrene, 150 g of n-butyl acrylate and 60 g of benzoyl peroxide, as a polymerization starter, was dripped into the system for 3 hours with stirring, during which time the solution polymerization took place. After the completion of dripping, the system was aged for 6 hours with stirring at the boiling temperature of toluene. 1 liter of toluene and 180 g of a resin with a peak molecular weight of 500,000, obtained by polymerizing 80 parts of styrene and 20 parts of n-butyl methacrylate, were put into this separatable flask. After the refluxing of toluene had begun, mixing was conducted with stirring for 5 hours. The system temperature was then gradually raised to 180° C., while toluene was removed under reduced pressure to obtain resin B which has a glass transition temperature of 63° C., a lower molecular weight peak at 8,000, a higher molecular weight peak at 500,000 and a peak height ratio between the higher molecular weight peak and the lower molecular weight peak of 0.2. Resin B, crushed with a 3-mm round-type screen of Fitz-mill DKA-6 (from Hosokawa Micron, Ltd.), had a BET specific surface area of 0.12 $m^2/g$, a packed bulk density of 0.60 g/cc, an angle of fall of 25 degrees and electrostatic charge of 1.5 μC. A toner with an average particle size of approximately 7 μm was prepared in the same manner as in Example 1 except for the fact that this resin was used. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted and high quality images with no image fogging or defective fixation were obtained. Also, no jamming onto the fixation roller was observed.

Example 3

1 liter of toluene was put into a 5-liter separatable flask. After the gas phase was replaced by nitrogen gas, the system was heated to the boiling point of toluene. After the refluxing of toluene had begun, a dissolved mixture of 850 g of styrene, 150 g of n-butyl acrylate and 70 g of t-butylperoxy -2-ethylhexanoate, as a polymerization starter, was dripped into the system for 3 hours with stirring, during which time the solution polymerization took place. After the completion of dripping, the system was aged for 6 hours with stirring at the boiling temperature of toluene. 1 liter of toluene and 350 g of a resin with a peak molecular weight of 900,000, obtained by polymerizing 80 parts of styrene and 20 parts of n-butyl acrylate, were put into this separatable flask. After the refluxing of toluene had begun, mixing was conducted with stirring for 5 hours. The system temperature was then gradually raised to 180° C., while toluene was removed under reduced pressure to obtain resin C which has a glass transition temperature of 58° C., a lower molecular weight peak at 7,000, a higher molecular weight peak at 900,000 and a peak height ratio between the higher molecular weight peak and the lower molecular weight peak of 0.4. Resin C, crushed with a 3-mm round-type screen of Fitz-mill DKA-6 (from Hosokawa Micron, Ltd.), had a BET specific surface area of 0.10 $m^2/g$, a packed bulk density of 0.62 g/cc, an angle of fall of 23 degrees and electrostatic charge of 1.0 μC. A toner with an average particle size of approximately 7 μm was prepared in the same manner as in Examples 1 except for the fact that this resin was used. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted and high quality images with no image fogging or defective fixation were obtained. Also, no jamming onto the fixation roller was observed.

Example 4

1 liter of toluene was put into a 5-liter separatable flask. After the gas phase was replaced by nitrogen gas, the system was heated to the boiling point of toluene. After the refluxing of toluene had begun, a dissolved mixture of 750 g of styrene, 250 g of n-butyl methacrylate and 20 g of benzoyl peroxide, as a polymerization starter, was dripped into the system for 3 hours with stirring, during which time the solution polymerization took place. After the completion of dripping, the system was aged for 6 hours with stirring at the boiling temperature of toluene. 1 liter of toluene and 260 g of a resin with a peak molecular weight of 600,000, obtained by polymerizing 80 parts of styrene and 20 parts of n-butyl methacrylate, were put into this separatable flask. After the refluxing of toluene had begun, mixing was conducted with stirring for 5 hours. The system temperature was then gradually raised to 180° C., while toluene was removed under reduced pressure to obtain resin D which has a glass transition temperature of 65° C., a lower molecular weight peak at 20,000, a higher molecular weight peak at 600,000 and a peak height ratio between the higher molecular weight peak and the lower molecular weight peak of 0.3. Resin D, crushed with a 3-mm screen of Bantam-mill AP-B (from Hosokawa Micron, Ltd.), had a BET specific surface area of 0.18 $m^2/g$, a packed bulk density of 0.57 g/cc, an angle of fall of 19 degrees and electrostatic charge of 0.94 μC. A toner with an average particle size of approximately 9 μm was prepared in the same manner as in Examples 1 except for the fact that this resin was used. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted and, although slight image fogging was observed, high quality images with no defective fixation were obtained. Also, no jamming onto the fixation roller was observed.

Example 5

1 liter of toluene was put into a 5-liter separatable flask. After the gas phase was replaced by nitrogen gas, the system was heated to the boiling point of toluene. After the refluxing of toluene had begun, a dissolved mixture of 750 g of styrene, 250 g of n-butyl methacrylate and 40 g of azobisisobutyronitrile benzoyl peroxide, as a polymerization starter, was dripped into the system for 3 hours with stirring, during which time the solution polymerization took place. After the completion of dripping, the system was aged for 6 hours with stirring at the boiling temperature of toluene. 1 liter of toluene and 360 g of a resin with a peak molecular weight of 800,000, obtained by polymerizing 80 parts of styrene and 20 parts of n-butyl acrylate, were put into this separatable flask. After the refluxing of toluene had begun, mixing was conducted with stirring for 5 hours. The system temperature was then gradually raised to 180° C., while toluene was removed under reduced pressure to obtain resin E which has a glass transition temperature of 60° C., a lower molecular weight peak at 12,000, a higher molecular weight peak at 800,000 and a peak height ratio between the higher molecular weight peak and the lower molecular weight peak of 0.4. Resin E, crushed with a 3-mm square-type screen of Fitz-mill DKA-6 (from Hosokawa Micron, Ltd.), had a BET specific surface area of 0.025 $m^2/g$, a packed bulk density of 0.65 g/cc, an angle of fall of 24 degrees and electrostatic charge of 0.4 μC. A toner with an average particle size of approximately 8 μm was prepared in the same manner as in Examples 1 except for the fact that this resin was used. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted and, although slight image fogging was observed, high quality images with no defective fixation were obtained. Also, no jamming onto the fixation roller was observed.

Example 6

Resin A of Example 1 was crushed with a 3-mm screen of Feather-mill FM-1 (from Hosokawa Micron, Ltd.) instead of a 3-mm round-type screen of Fitz -mill DKA-6 (from Hosokawa Micron, Ltd.). The product had a BET specific surface area of 0.015 $m^2/g$, a packed bulk density of 0.66 g/cc, an angle of fall of 26 degrees and electrostatic charge of 0.7 μC. A toner with an average particle size of approximately 8 μm was prepared in the same manner as in Examples 1 except for the fact that this resin was used. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted and, although slight image fogging was observed and there were a few missing characters at around 5,000 copies, high quality images with no defective fixation were obtained. Also, no jamming onto the fixation roller was observed.

Example 7

Resin A of Example 1 was crushed with a 3-mm screen of Pulverizer AP-ISH (from Hosokawa Micron, Ltd.) instead of a 3-mm round-type screen of Fitz -mill DKA-6 (from Hosokawa Micron, Ltd.). The product had a BET specific surface area of 0.42 $m^2/g$, a packed bulk density of 0.54 g/cc, an angle of fall of 26 degrees and electrostatic charge of 0.7 μC. A toner with an average particle size of approximately 8 μm was prepared in the same manner as in Examples 1 except for the fact that this resin was used. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted and, although slight image fogging was observed and there were a few missing characters at around 3,000 copies, high quality images with no defective fixation were obtained. Also, no jamming onto the fixation roller was observed.

Comparative Example 1

Resin A of Example 1 was crushed with a 5-mm screen of Hammer-mill H-12 (from Hosokawa Micron, Ltd.) instead of a 3-mm round-type screen of Fitz -mill DKA-6 (from Hosokawa Micron, Ltd.). The product had a BET specific surface area of 0.009 $m^2/g$, a packed bulk density of 0.67 g/cc, an angle of fall of 27 degrees and electrostatic charge of 0.7 μC. A toner with an average particle size of approximately 8 μm was prepared in the same manner as in Examples 1 except for the fact that this resin was used. No aggregation was observed in the aggregation testing. No offset was observed on copied images even with a fixation roller temperature of 200° C. Defective fixation was found in some areas when images fixed with a fixation roller temperature of 170° C. were rubbed with a finger. A running test of 10,000 copies was conducted. As a result, image fogging observed and there were missing characters. No jamming onto the fixation roller was observed.

Comparative Example 2

Resin A of Example 1 was crushed with Kolloplex 160Z (from Hosokawa Micron, Ltd. ) instead of a 3-mm mm round-type screen of Fitz-mill DKA-6 (from Hosokawa Micron, Ltd.). The product had a BET specific surface area of 1.1 $m^2/g$, a packed bulk density of 0.48 g/cc, an angle of fall of 15 degrees and electrostatic charge of 0.7 μC. A toner with an average particle size of approximately 8 μm was prepared in the same manner as in Examples 1 except for the fact that this resin was used. No aggregation was observed in the aggregation testing. No offset was observed on copied images even with a fixation roller temperature of 200° C. Defective fixation was found in some areas when images fixed with a fixation roller temperature of 170° C. were rubbed with a finger. A running test of 10,000 copies was conducted. As a result, image fogging observed and there were missing characters. No jamming onto the fixation roller was observed.

Comparative Example 3

After resin A of Example 1 was crushed with a 3-mm round-type screen of Fitz-mill DKA-6 (from Hosokawa Micron, Ltd.), a heat treatment was conducted at 55° C. for 8 hours. The product had a BET specific surface area of 0.018 $m^2/g$, a packed bulk density of 0.69 g/cc, an angle of fall of 21 degrees and electrostatic charge of 0.7 μC. A toner with an average particle size of approximately 8 μm was prepared in the same manner as in Examples 1 except for the fact that this resin was used. No aggregation was observed in the aggregation testing. No offset was observed on copied images even with a fixation roller temperature of 200° C. Fixation was somewhat weak when images fixed with a fixation roller temperature of 170° C. were rubbed with a finger. A running test of 10,000 copies was conducted. As a result, some image fogging was observed and there were missing characters. No jamming onto the fixation roller was observed.

Comparative Example 4

A resin was prepared in the same manner as in Example 1 except for the fact that 780 g, instead of 850 g, of styrene and 220 g, instead of 150 g, of n-butyl acrylate were used to obtain resin F which has a glass transition temperature of 48° C., a lower molecular weight peak at 15,000, a higher molecular weight peak at 400,000 and a peak height ratio between the higher molecular weight peak and the lower molecular weight peak of 0.6. Resin F, crushed with a 3-mm screen of Pulverizer AP-ISH (from Hosokawa Micron, Ltd.), had a BET specific surface area of 0.31 $m^2/g$, a packed bulk density of 0.66 g/cc, an angle of fall of 32 degrees and electrostatic charge of 0.6 μC. A toner with an average particle size of approximately 8 μm was prepared in the same manner as in Examples 1 except for the fact that this resin was used. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted. As a result, image fogging was observed and there were some missing characters. No jamming onto the fixation roller was observed.

Comparative Example 5

A resin was prepared in the same manner as in Example 1 except for the fact that 780 g of styrene and 30 g of acrylic acid, instead of 850 g of styrene, were used to obtain resin G which has a glass transition temperature of 64° C., a lower molecular weight peak at 15,000, a higher molecular weight peak at 400,000 and a peak height ratio between the higher molecular weight peak and the lower molecular weight peak of 0.6. Resin G, crushed with a 3-mm screen of Pulverizer AP-ISH (from Hosokawa Micron, Ltd.), had a BET specific surface area of 0.38 $m^2/g$, a packed bulk density of 0.64 g/cc, an angle of fall of 21 degrees and electrostatic charge of 3.2 μC. A toner with an average particle size of approximately 8 μm was prepared in the same manner as in Examples 1 except for the fact that this resin was used. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted. As a result, image fogging was observed and there were some missing characters. No jamming onto the fixation roller was observed.

Comparative Example 6

A resin was prepared in the same manner as in Example 1 except for the fact that 50 g of dioctyl phthalate was added as a compatibilizer to obtain resin H which has a glass transition temperature of 50° C., a lower molecular weight peak at 15,000, a higher molecular weight peak at 400,000 and a peak height ratio between the higher molecular weight peak and the lower molecular weight peak of 0.6. Resin H, crushed with a 3-mm screen of Pulverizer AP-ISH (from Hosokawa Micron, Ltd.), had a BET specific surface area of 0.33 $m^2/g$, a packed bulk density of 0.66 g/cc, an angle of fall of 25 degrees and electrostatic charge of 0.6 μC. A toner with an average particle size of approximately 8 μm was prepared in the same manner as in Examples 1 except for the fact that this resin was used. Some aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted. As a result, slight image fogging was observed. Jamming onto the fixation roller occurred.

Comparative Example 7

A resin was prepared in the same manner as in Example 1 except for the fact that 100 g, instead of 550 g, of the resin with a peak molecular weight of 400,000 was used to obtain resin I which has a glass transition temperature of 62° C., a lower molecular weight peak at 15,000, a higher molecular weight peak at 400,000 and a peak height ratio between the higher molecular weight peak and the lower molecular weight peak of 0.1. Resin I, crushed with a 3-mm round-type screen of Fitz-mill DKA-6 (from Hosokawa Micron, Ltd.), had a BET specific surface area of 0.23 $m^2/g$, a packed bulk density of 0.59 g/cc, an angle of fall of 20 degrees and electrostatic charge of 0.8 μC. A toner with an average particle size of approximately 8 μm was prepared in the same manner as in Examples 1 except for the fact that this resin was used. No aggregation was observed in the aggregation testing. Offset was observed on copied images with a fixation roller temperature of 190° C. Images fixed with a fixation roller temperature of 170° C. were sufficiently fixed even after being rubbed with a finger. A running test of 10,000 copies was conducted. As a result, some image fogging was observed. No jamming onto the fixation roller was observed.

Comparative Example 8

A toner with an average particle size of approximately 14 μm was prepared according to Comparative example 1. No aggregation was observed in the aggregation testing. No offset was observed on copied images even with a fixation roller temperature of 200° C. Images fixed with a fixation roller temperature of 170° C. were sufficiently fixed even after being rubbed with a finger. A running test of 10,000 copies was conducted. As a result, image fogging was observed. No jamming onto the fixation roller was observed.

Results of the aforementioned Examples and Comparative examples are summarized in Table 1 and Table 2. In the tables, LP stands for the peak value of the lower molecular weight ingredient in the molecular weight distribution of the vinyl-type copolymer for the main binder, HP stands for the peak value of the higher molecular weight ingredient, and HP/LP stands for the peak height ratio of these peaks. In the tables, ⊙, ○, Δ and × mean "very good", "good", "somewhat poor" and "poor" respectively, characterizing results for each item.

TABLE 1

| | Examples | | | | | | |
|---|---|---|---|---|---|---|---|
| | 1 | 2 | 3 | 4 | 5 | 6 | 7 |
| LP | $1.5 \times 10^4$ | $0.8 \times 10^4$ | $0.7 \times 10^4$ | $2.0 \times 10^4$ | $1.2 \times 10^4$ | $1.5 \times 10^4$ | $1.5 \times 10^4$ |
| HP | $40 \times 10^4$ | $50 \times 10^4$ | $90 \times 10^4$ | $60 \times 10^4$ | $80 \times 10^4$ | $40 \times 10^4$ | $40 \times 10^4$ |
| HP/LP | 0.6 | 0.2 | 0.4 | 0.3 | 0.4 | 0.6 | 0.6 |
| BET specific surface area ($m^2/g$) | 0.08 | 0.12 | 0.10 | 0.18 | 0.025 | 0.015 | 0.42 |
| Packed bulk density (g/cc) | 0.64 | 0.60 | 0.62 | 0.57 | 0.65 | 0.66 | 0.54 |
| Angle of fall | 21 | 25 | 23 | 19 | 24 | 26 | 26 |
| Electrostatic charge (μC) | 0.7 | 1.5 | 1.0 | 0.94 | 0.4 | 0.7 | 0.7 |
| Particle size (μm) | 8 | 7 | 7 | 9 | 8 | 8 | 8 |
| Aggregation | ⊙ | ⊙ | ⊙ | ⊙ | ⊙ | ⊙ | ⊙ |
| Offset | ≧200° C. | ≧200° C. | ≧200° C. | ≧200° C. | ≧200° C. | ≧200° C. | ≧200° C. |
| Fixation | ⊙ | ⊙ | ⊙ | ⊙ | ⊙ | ⊙ | ⊙ |
| Image fogging | ⊙ | ⊙ | ⊙ | ○ | ○ | ○ | ○ |
| Missing characters | ⊙ | ⊙ | ⊙ | ⊙ | ⊙ | ○ | ○ |
| Jamming | ⊙ | ⊙ | ⊙ | ⊙ | ⊙ | ⊙ | ⊙ |

TABLE 2

| | Comparative examples | | | | | | | |
|---|---|---|---|---|---|---|---|---|
| | 1 | 2 | 3 | 4 | 5 | 6 | 7 | 8 |
| LP | $1.5 \times 10^4$ | $1.5 \times 10^4$ | $1.5 \times 10^4$ | $1.5 \times 10^4$ | $1.5 \times 10^4$ | $1.5 \times 10^4$ | $1.5 \times 10^4$ | $1.5 \times 10^4$ |
| HP | $40 \times 10^4$ | $40 \times 10^4$ | $40 \times 10^4$ | $40 \times 10^4$ | $40 \times 10^4$ | $40 \times 10^4$ | $40 \times 10^4$ | $40 \times 10^4$ |
| HP/LP | 0.6 | 0.6 | 0.6 | 0.6 | 0.6 | 0.6 | 0.1 | 0.6 |
| BET specific surface area ($m^2/g$) | 0.009 | 1.1 | 0.018 | 0.31 | 0.38 | 0.33 | 0.23 | 0.009 |
| Packed bulk density (g/cc) | 0.67 | 0.48 | 0.69 | 0.66 | 0.64 | 0.66 | 0.59 | 0.67 |
| Angle of fall | 27 | 15 | 21 | 32 | 21 | 25 | 20 | 27 |
| Etectrostatic charge (μC) | 0.7 | 0.7 | 0.7 | 0.6 | 3.2 | 0.6 | 0.8 | 0.7 |
| Particle size (μm) | 8 | 8 | 8 | 8 | 8 | 8 | 8 | 14 |
| Aggregation | ⊙ | ⊙ | ⊙ | X | ⊙ | Δ | ⊙ | ⊙ |
| Offset | ≧200° C. | ≧200° C. | ≧200° C. | ≧200° C. | ≧200° C. | ≧200° C. | 190° C. | ≧200° C. |
| Fixation | X | X | Δ | ⊙ | ⊙ | ⊙ | ⊙ | ⊙ |
| Image fogging | X | X | Δ | X | X | ○ | ○ | X |
| Missing characters | X | X | Δ | Δ | Δ | ⊙ | ⊙ | ⊙ |
| Jamming | ⊙ | ⊙ | ⊙ | ⊙ | ⊙ | X | ⊙ | ⊙ |

What is claimed is:

1. A toner whose main binder is an isoprene free vinyl-type copolymer which has a styrene-type monomer and/or a (meth)acrylic ester monomer as constituent units wherein the vinyl-type copolymer has peaks of the molecular weight distribution at least in the range from $3\times10^3$ to $4\times10^4$ and in the range from $3\times10^5$ to $8\times10^6$, and the BET specific surface area of the main binder is 0.02–0.2 $m^2/g$.

2. The toner of claim 1 wherein the average particle size of said toner is 10 μm or less.

3. The toner of claim 1 wherein the peak height ratio between the peak in the range from $3\times10^3$ to $4\times10^4$ and the peak in the range from $3\times10^5$ to $8\times10^6$ in the molecular weight distribution is 0.15–1.0.

4. The toner of claim 1 wherein the packed bulk density of said main binder is less than 0.68 g/cc.

5. The toner of claim 1 wherein the angle of fall of said main binder is less than 27 degrees.

6. The toner of claim 1 wherein the electrostatic charge of said main binder is less than 3 μC/g.

7. The toner of claim 1 wherein the average particle size of said toner is 10 μm or less; and the peak height ratio between the peak in the range from $3\times10^3$ to $4\times10^4$ and the peak in the range from $3\times10^5$ to $8\times10^6$ in the molecular weight distribution is 0.15–1.0.

8. The toner of claim 1 wherein the average particle size of said toner is 10 μm or less;

the peak height ratio between the peak in the range from $3\times10^3$ to $4\times10^4$ and the peak in the range from $3\times10^5$ to $8\times10^6$ in the molecular weight distribution is 0.15–1.0; and the packed bulk density of said main binder is less than 0.68 g/cc.

9. The toner of claim 1 wherein the average particle size of said toner is 10 μm or less;

the peak height ratio between the peak in the range from $3\times10^3$ to $4\times10^4$ and the peak in the range from $3\times10^5$ to $8\times10^6$ in the molecular weight distribution is 0.15–1.0;

the packed bulk density of said main binder is less than 0.68 g/cc; and the angle of fall of said main binder is less than 27 degrees.

10. The toner of claim 1 wherein the average particle size of said toner is 10 μm or less;

the peak height ratio between the peak in the range from $3\times10^3$ to $4\times10^4$ and the peak in the range from $3\times10^5$ to $8\times10^6$ in the molecular weight distribution is 0.15–1.0;

the packed bulk density of said main binder is less than 0.68 g/cc;

the angle of fall of said main binder is less than 27 degrees; and the electrostatic charge of said main binder is less than 3 μC/g.

11. A toner whose main binder is an isoprene free vinyl-type copolymer which has a styrene-type monomer and/or a (meth) acrylic ester monomer as constituent units wherein the vinyl-type copolymer has peaks of the molecular weight distribution at least in the range from $3\times10^3$ to $4\times10^4$ and in the range from $3\times10^5$ to $8\times10^6$, the BET specific surface area of the main binder is 0.02–0.2 $m^2/g$, the average particle size of the toner is 10 μm or less, the peak height ratio between the peak in the range from $3\times10^3$ to $4\times10^4$ and the peak in the range from $3\times10^5$ to $8\times10^6$ in the molecular weight distribution is 0.15–1.0, the packed bulk density of the binder is less than 0.68 g/cc, the angle of fall of the binder is less than 27 degrees, and the electrostatic charge of the binder is less than 3 μC/g.

* * * * *